US010262673B2

(12) United States Patent
Ray et al.

(10) Patent No.: US 10,262,673 B2
(45) Date of Patent: Apr. 16, 2019

(54) SOFT-TALK AUDIO CAPTURE FOR MOBILE DEVICES

(71) Applicant: Knowles Electronics, LLC, Itasca, IL (US)

(72) Inventors: Jonathon Ray, Itasca, IL (US); Anil Kumar Yadav, Itasca, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 15/886,288

(22) Filed: Feb. 1, 2018

(65) Prior Publication Data

US 2018/0233158 A1 Aug. 16, 2018

Related U.S. Application Data

(60) Provisional application No. 62/458,084, filed on Feb. 13, 2017.

(51) Int. Cl.
*G10L 21/0208* (2013.01)
*G10L 21/0232* (2013.01)
*G10L 21/0216* (2013.01)

(52) U.S. Cl.
CPC ..... *G10L 21/0208* (2013.01); *G10L 21/0232* (2013.01); *G10L 2021/02165* (2013.01)

(58) Field of Classification Search
CPC ..... G10L 21/0208; G10L 2021/02165; G10L 21/0232
See application file for complete search history.

(56) References Cited

U.S. PATENT DOCUMENTS 8,032,364 B1 10/2011 Watts
8,194,882 B2 6/2012 Every et al.
8,204,253 B1 6/2012 Solbach
8,447,596 B2 5/2013 Avendano et al.
8,538,035 B2 9/2013 Every et al.
8,606,571 B1 * 12/2013 Every ..... G10L 21/0232 375/285
8,682,006 B1 3/2014 Laroche et al.
8,718,290 B2 5/2014 Murgia et al.
(Continued)

OTHER PUBLICATIONS

International Search Report and Written Opinion, PCT/US2018/016435, Knowles Electronics, LLC, 12 pages (dated Mar. 20, 2018).

*Primary Examiner* — Sonia L Gay
(74) *Attorney, Agent, or Firm* — Foley & Lardner LLP

(57) ABSTRACT

A method for reducing noise within an acoustic signal includes receiving at least a primary acoustic signal from a primary microphone and a secondary acoustic signal from a different, secondary microphone, wherein the primary acoustic signal includes a speech component emanating from a user and a noise component. The method also includes measuring a first value of a first coefficient based on the primary and secondary signals and performing a noise cancellation process based on the measured first value of the first coefficient to produce a set of noise-cancelled primary sub-bands. The method also includes generating, by the processor, a set of multiplicative gain mask values, the multiplicative gain mask values having a frequency dependency that is based at least in part on a pre-indicated approximate sound pressure level of the speech component.

20 Claims, 9 Drawing Sheets

(56) References Cited

U.S. PATENT DOCUMENTS

| | | | |
|---|---|---|---|
| 8,744,844 | B2 | 6/2014 | Klein |
| 8,774,423 | B1 | 7/2014 | Solbach |
| 8,781,137 | B1 | 7/2014 | Goodwin |
| 8,798,289 | B1 | 8/2014 | Every et al. |
| 8,831,937 | B2 | 9/2014 | Murgia et al. |
| 8,886,525 | B2 | 11/2014 | Klein |
| 8,949,120 | B1 | 2/2015 | Every et al. |
| 8,958,572 | B1 | 2/2015 | Solbach |
| 9,143,857 | B2 | 9/2015 | Every et al. |
| 9,185,487 | B2 | 11/2015 | Solbach et al. |
| 9,197,974 | B1 | 11/2015 | Clark et al. |
| 9,343,056 | B1 | 5/2016 | Goodwin |
| 9,343,073 | B1 | 5/2016 | Murgia et al. |
| 9,431,023 | B2 | 8/2016 | Avendano et al. |
| 9,437,180 | B2 | 9/2016 | Murgia et al. |
| 9,438,992 | B2 | 9/2016 | Every et al. |
| 9,554,214 | B2 | 1/2017 | Nielsen et al. |
| 9,558,755 | B1 | 1/2017 | Laroche et al. |
| 9,640,194 | B1 | 5/2017 | Nemala et al. |
| 9,699,554 | B1 | 7/2017 | Choi et al. |
| 9,799,330 | B2 | 10/2017 | Nemala et al. |
| 9,820,042 | B1 | 11/2017 | Ray et al. |
| 9,830,899 | B1 | 11/2017 | Every et al. |
| 9,838,784 | B2 | 12/2017 | Vallabhan et al. |
| 2005/0015252 | A1* | 1/2005 | Marumoto ..... G10L 21/02 704/234 |
| 2006/0200344 | A1 | 9/2006 | Kosek et al. |
| 2010/0150374 | A1* | 6/2010 | Bryson ..... H04B 1/3822 381/86 |
| 2011/0268288 | A1* | 11/2011 | Tanaka ..... G10L 21/0208 381/71.1 |
| 2016/0027451 | A1 | 1/2016 | Solbach et al. |
| 2016/0063997 | A1 | 3/2016 | Nemala et al. |
| 2016/0066087 | A1 | 3/2016 | Solbach et al. |
| 2016/0066089 | A1 | 3/2016 | Klein |
| 2016/0196838 | A1 | 7/2016 | Rossum et al. |

* cited by examiner

SOFT-TALK AUDIO CAPTURE FOR MOBILE DEVICES

CROSS-REFERENCE TO RELATED APPLICATIONS

This application claims priority to U.S. Provisional Application No. 62/458,084 filed Feb. 13, 2017, the contents of which are incorporated herein by reference in their entirety.

TECHNICAL FIELD

This application relates generally to audio processing and more particularly to adaptive noise suppression of an audio signal.

BACKGROUND

Speaking with others via a handset device raises privacy concerns. If a user speaks into the handset device at a normal volume in a crowded area, for example, unintended listeners may hear the user's conversation. This is especially problematic if the user is communicating private information. In such a case, a user may speak quietly into the handset device. Generally such quiet speech leads to a low signal-to-noise ratio ("SNR") and a muffled profile in the resulting acoustic signal, making it difficult for the intended recipient to hear.

Various techniques have been aimed at solving this problem. For example, amplification or automatic gain control techniques may be used to increase the signal's volume. While this may make the signal easier to hear, it does little to remove noise from the signal or to smooth the profile of the signal. As such, the resulting signal is still difficult for the intended recipient to understand.

The limitations of previous approaches have resulted in some user dissatisfaction with these previous approaches.

BRIEF DESCRIPTION OF THE DRAWINGS

For a more complete understanding of the disclosure, reference should be made to the following detailed description and accompanying drawings wherein.

DETAILED DESCRIPTION

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

Approaches are provided that increase the clarity and volume of an acoustic signal produced by a user speaking quietly into an audio device. More specifically and in one aspect, the acoustic signal is received by at least two microphones (e.g., a first microphone and a second microphone). Based on the interrelationship between the two microphones, a coefficient $\hat{\sigma}$ is applied to a first signal of the first microphone and subtracted from a second signal from the second microphone to approximate the noise in the environment of the audio device. According to various embodiments disclosed herein, the coefficient $\hat{\sigma}$ is selectively adapted from one frame to the next towards an observed target speech signal subject to various constraints that are specifically tailored for a soft talking use case. Specifically, the constraints for adaptation of the constant $\hat{\sigma}$ are specially chosen to cancel noise in the environment emanating from sources other than the user's mouth providing robust cancellation of noise even in the low SNR soft talking use case.

In another aspect, a gain mask is applied to the acoustic signal that is specifically tailored for the soft talk use case. More specifically, lower bound gain amplitudes associated with a mask are specifically chosen to provide robust noise suppression in a predetermined frequency band. As compared to a normal-talk use case, the systems and methods disclosed herein provide for more robust noise suppression in frequency bands above a predetermined frequency threshold and for more relaxed noise suppression in frequency bands below the predetermined threshold. As will be described below, application of such a mask facilitates the preservation of a speech signal that is most important for intelligibility.

In yet another aspect, a noise gate is applied to the acoustic signal to provide for further noise suppression in certain frequency ranges. The frequency range is specifically chosen to attenuate frequency bands that are unnecessary to understand a soft-talk acoustic signal. As such, the noise gate provides for further suppression of noise in the output signal without distorting the most crucial speech signal components. As a result, the clarity and intelligibility of the output signal is enhanced.

Figure 1:
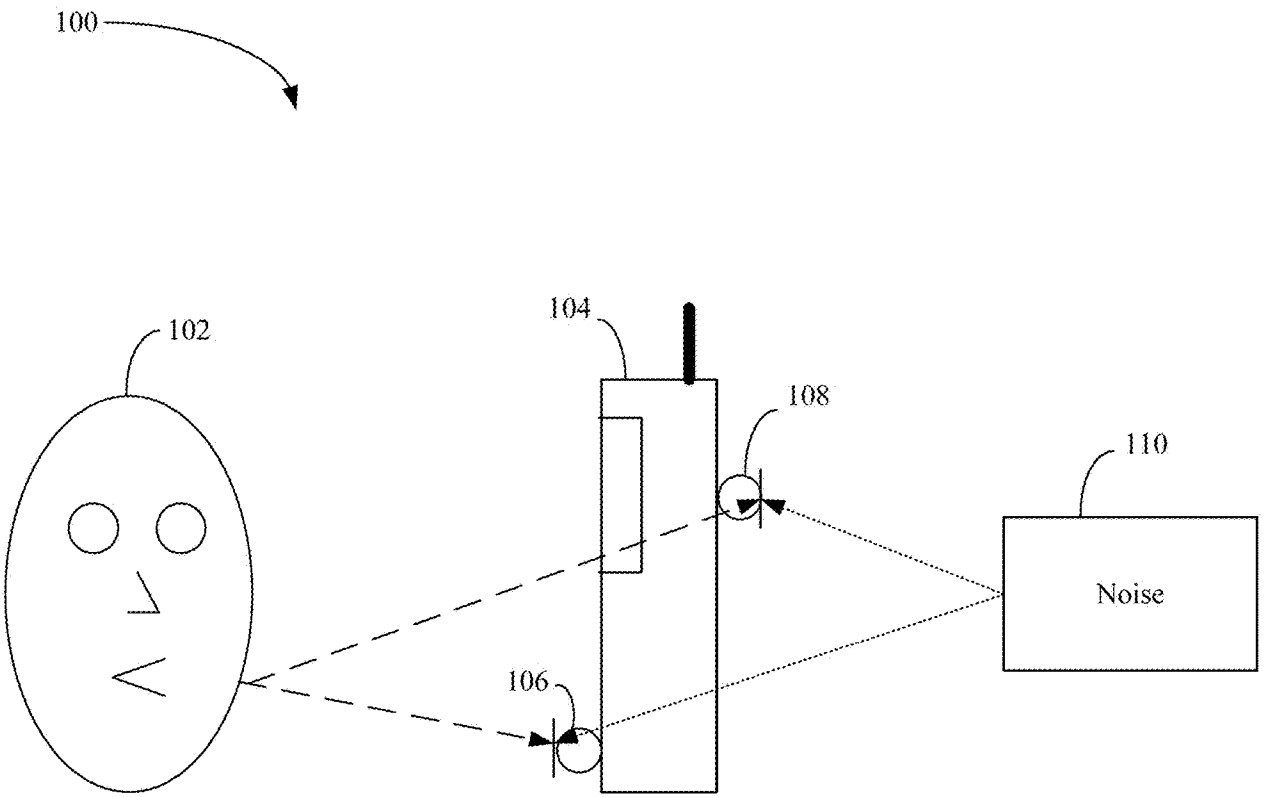
FIG. 1 comprises an environment in which the audio processing system disclosed herein may be used, according to an example embodiment.

Referring now to FIG. 1, an environment 100 in which various embodiments disclosed herein may be practiced is shown. A user acts as an audio source 102 to an audio device 104. The example audio device 104 may include a microphone array.

In various embodiments, the microphone array includes a primary microphone 106 relative to the audio source 102 and a secondary microphone 108 located a distance away from the primary microphone 106. While embodiments of the present invention will be discussed with regards to having two microphones 106 and 108, alternative embodiments may contemplate any number of microphones or acoustic sensors within the microphone array. In some embodiments, the microphones 106 and 108 may comprise omni-directional microphones.

While the microphones 106 and 108 receive sound (i.e., acoustic signals) from the audio source 102, the microphones 106 and 108 also pick up noise 110. Although the noise 110 is shown coming from a single location in FIG. 1, the noise 110 may comprise any sounds from one or more locations different than the audio source 102, and may include reverberations and echoes. The noise 110 may be stationary, non-stationary, or a combination of both stationary and non-stationary noise.

Figure 2:
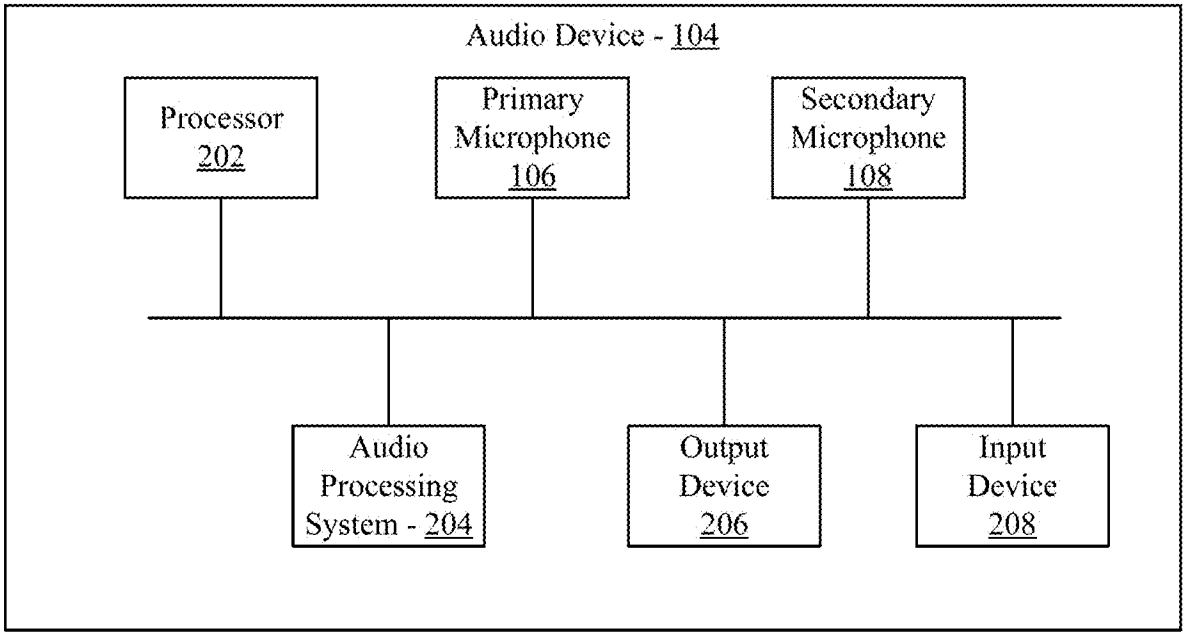
FIG. 2 comprises a block diagram of an audio device including the audio processing system disclosed herein, according to an example embodiment.

Referring now to FIG. 2, the exemplary audio device 104 is shown in more detail. In exemplary embodiments, the audio device 104 is an audio receiving device that comprises a processor 202, the primary microphone 106, the secondary microphone 108, an audio processing system 204, an output device 206, and an input device 208. The audio device 104 may comprise further components (not shown) necessary for audio device 104 operations. The audio processing system 204 will be discussed in more detail in connection with FIG. 3.

In exemplary embodiments, the primary and secondary microphones 106 and 108 are spaced a distance apart in order to allow for an energy level difference between them. Upon receipt by the microphones 106 and 108, the acoustic signals may be converted into electric signals (i.e., a primary electric signal and a secondary electric signal). The electric signals may be converted by an analog-to-digital converter (not shown) into digital signals for processing in accordance with some embodiments. In order to differentiate the acoustic signals, the acoustic signal received by the primary microphone 106 is herein referred to as the primary acoustic signal, while the acoustic signal received by the secondary microphone 108 is herein referred to as the secondary acoustic signal.

The output device 206 is any device which provides an audio output to the user. For example, the output device 206 may comprise an earpiece of a headset or handset, or a speaker on a conferencing device. In some embodiments, the output device 206 may also be a device that outputs or transmits to other users. In some embodiments, the output device 206 may also produce an output that serves various other functions. The output device 206 may provide inputs to other systems associated with the audio device 104 voice recognition. For example, the output device 206 may produce an acoustic signal that serves as a password to enable the user to gain access to sensitive information (e.g., banking credentials). In another example, the output may provide a command for various logics in systems associated with the audio device 104. In another example, the output may be used for voice recognition.

The input device 208 is any device which provides a user input to the audio device 104. The input device 208 includes hardware and associated logics configured to receive user inputs. For example, the input device 208 may include, for example, a mechanical keyboard, a touchscreen, a microphone, a camera, a fingerprint scanner, any user input device engageable with the audio device 204 via a USB, serial cable, Ethernet cable, and so on.

In various embodiments, the user can provide an input to the audio processing system 204 via the input device 208 that pre-indicates to the audio processing system 204 an approximate sound pressure level of a speech component s(k) of an upcoming signal. In various example embodiments, the approximate sound pressure level can take one of two values. The first value may correspond to normal talking mode and thus pre-indicate to the audio processing system 204 that an upcoming speech component s(k) of an acoustic signal is going to be at a sound pressure level that is proximate to average conversational speech (e.g., approximately 60 dB). The first value may be the default level for the audio processing system. However, as disclosed herein, the user can provide an input to the audio processing system 204 (e.g., by tapping an icon on a touchscreen of the audio device 104) to pre-indicate to the audio processing system 204 that an upcoming speech component s(k) is going to have a sound pressure level that is below the average of conversational speech. In various arrangements, such an input places the audio processing system 204 in the soft talking mode described herein. In other embodiments, the audio device 104 may be permanently preconfigured to be in the soft talking mode described herein. Alternatively or additionally, rather than the previously discussed input being provided by the user, the input may be provided by an input determination module of the audio processing system 204 described below.

Figure 3:
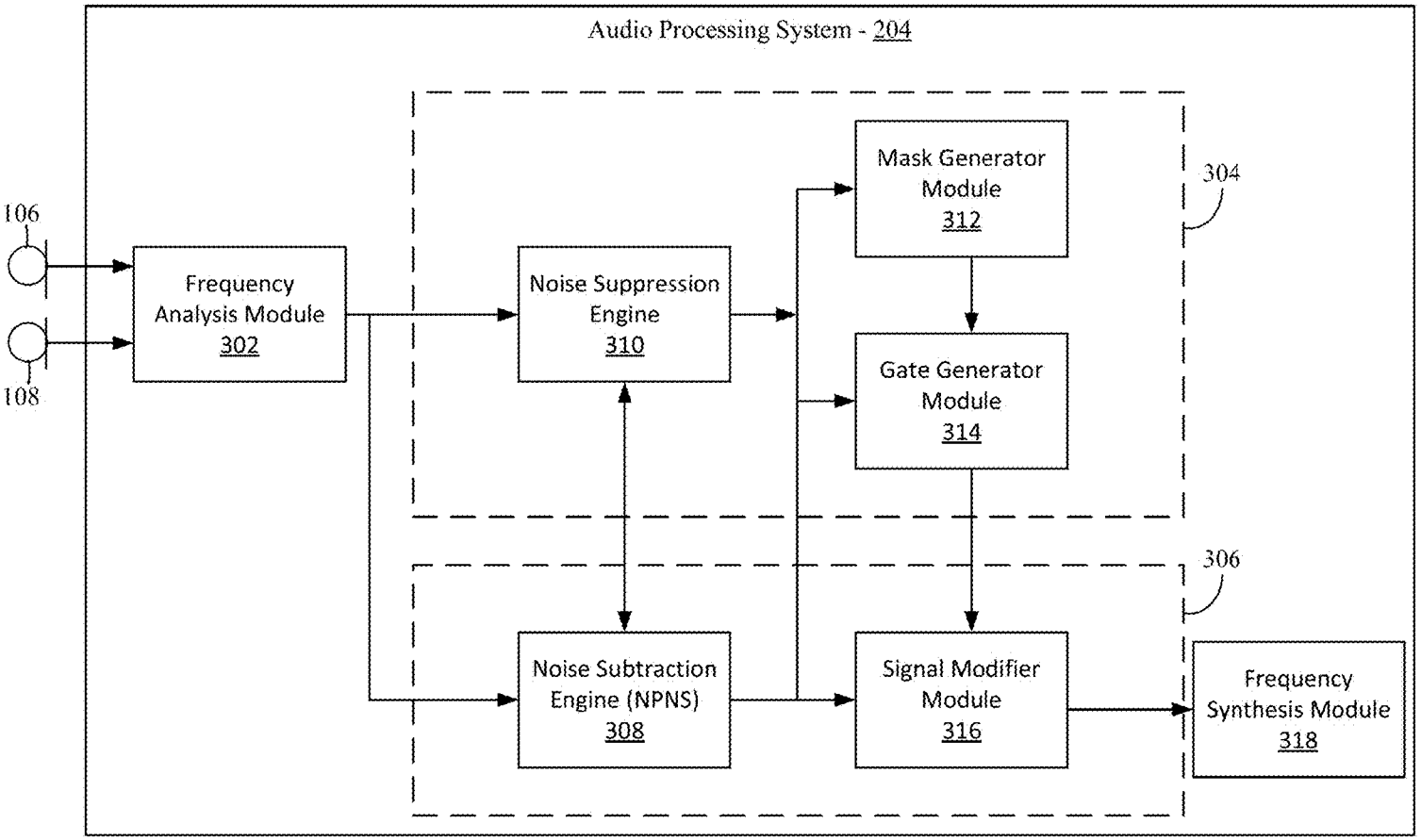
FIG. 3 comprises a block diagram of the audio processing system disclosed herein, according to an example embodiment.

Referring now to FIG. 3, a block diagram of the audio processing system 204 is shown, according to an example embodiment. In various embodiments, the audio processing system is embodied within a memory device of the audio device 104.

In operation, the acoustic signals received from the primary and secondary microphones 106 and 108 are converted to electric signals and processed through a frequency analysis module 302. In one embodiment, the frequency analysis module 302 takes the acoustic signals and mimics the frequency analysis of the cochlea (i.e., cochlear domain) simulated by a filter bank. In one example, the frequency analysis module 302 separates the acoustic signals into frequency sub-bands. A sub-band is the result of a filtering operation on an input signal where the bandwidth of the filter is narrower than the bandwidth of the signal received by the frequency analysis module 302. Alternatively, other filters such as short-time Fourier transform (STFT), sub-band filter banks, modulated complex lapped transforms, cochlear models, wavelets, etc., can be used for the frequency analysis and synthesis. Because most sounds (e.g., acoustic signals) are complex and comprise more than one frequency, a sub-band analysis on the acoustic signal determines what individual frequencies are present in the complex acoustic signal during a frame (e.g., a predetermined period of time). According to one embodiment, the frame is 10 ms long. Alternative embodiments may utilize other frame lengths or no frame at all. The results may comprise sub-band signals in fast cochlea transform (FCT) domain. For more information regarding an example cochlea transform, see U.S. Pat. No. 8,774,423 entitled "Systems and Method for Controlling Adaptivity of Signal Modification Using A Phantom Coefficient," herein incorporated by reference in its entirety. The sub-band frame signals of the primary acoustic signal from the primary microphone 106 is expressed as c(k), and the sub-band frame signals of the secondary acoustic signal from the secondary microphone 108 is expressed as f(k), with k indicating a specific sub-band k from 1 to K total number of sub-bands covering the acoustic spectrum. In one example embodiment, K is 52.

The sub-band frame signals c(k) and f(k) are provided from frequency analysis module 302 to an analysis path sub-system 304 and to a signal path sub-system 306. In various example embodiments, the analysis path sub-system 304 processes the sub-band frame signals to identify signal features, distinguish between speech and noise components, perform power spectral density estimates, estimate the SNR of the signals, and generate signal modifiers (e.g., a gain mask and/or a noise gate). The signal path sub-system 306 modifies the primary sub-band frame signal by adaptively subtracting noise components from the primary signal c(k) to create a noise-cancelled signal c'(k) and applying the modifiers, generated in the analysis path sub-system 304, to the noise-cancelled signal c'(k) to produce an output.

Signal path sub-system 306 includes a noise subtraction engine 308 and a signal modifier module 316. The noise subtraction engine 308 receives the sub-band frame signal c(k) and f(k) from the frequency analysis module 302 and, using techniques described below, the noise subtraction engine 308 cancels noise components from one or more primary sub-band signals c(k) to produce a noise-cancelled signal c'(k). The operation of the noise subtraction engine 308 will be described in more detail below with respect to FIGS. 4A-4B. As will be described below, the operation of the noise subtraction engine 308 is dependent on the mode that the audio processing system 204 has been placed in by the user. In a soft talking mode, for example, adaptation of a speech cancellation coefficient $\hat{\sigma}$ used in the processes described blow is subject to much stricter constraints than when the audio processing system 204 is in normal talking mode.

Analysis path sub-system 304 includes a noise suppression engine 310, a mask generator module 312, and a gate generator module 314. The noise suppression engine 310 receives the sub-band frame signals c(k) and f(k) provided by the frequency analysis module 302 and computes, for example, transfer functions between the sub-band signals, frame energy estimations of sub-band frame signals, inter-microphone level differences (ILDs) between the sub-band frame signals, inter-microphone phase differences (IPDs) between the sub-band frame signals, cross-correlations between the sub-band frame signals, and autocorrelations of the sub-band frame signals. Various outputs of the noise suppression engine 310 are communicated to the noise subtraction engine 308 for use in the processes to be described below.

The noise suppression engine 310 may further include an adaptive classifier module (not shown) configured to differentiate speech and noise components of the sub-band frame signals c(k) and f(k). The classifications made by the adaptive classifier may change depending on the acoustic environment of the audio device 104. For example, the adaptive classifier may maintain a global average running mean and variance (i.e., cluster) for the source s(k), noise n(k), and other components (e.g., distractors) of the primary and secondary signals c(k) and f(k). For more detail on one example adaptive classifier see U.S. Pat. No. 9,185,487, entitled "System and Methods for Providing Noise Suppression Utilizing Null Processing Noise Subtraction," which is incorporated by reference herein in its entirety. In various embodiments, the results of the adaptive classifier may be used by the noise suppression engine 310 to, for example, estimate various energies of the speech and noise components s(k) and n(k) of the sub-band frame signals c(k) and f(k) and produce models of the speech and noise components s(k) and n(k).

In various example embodiments, the analysis path sub-system 304 may also include an input determination module (not shown). The input determination module may receive various outputs of the noise suppression engine 310 such as ILD estimates, IPD estimates, SNR estimates, cross correlations between the primary and secondary signals c(k) and f(k), and autocorrelations of the signals c(k) and f(k). The input determination module may include a set of parameters used to distinguish between situations where the audio processing system 204 should be placed in the soft talking mode for an optimized output and situations where the audio processing system 204 should be in the normal talking mode for an optimized output. For example, as well as other estimates for various other cues, the input determination module may include a set of ILD estimates and a set of IPD estimates for situations when users are speaking at a normal conversational volume and when users are speaking softly. The estimates may be pre-calibrated values or based on historical values measured by the noise suppression engine 310 when the audio processing system 204 has been placed into the soft talking mode or normal talking mode by the user.

In various example embodiments, the input determination module may compare the real-time ILD and IPD values associated with the primary and secondary acoustic signals c(k) and f(k) measured by the noise suppression engine 310 to the estimates. If, for example, the measured values of the ILD and IPD are within a predetermined threshold of the estimates associated with a particular mode for a predetermined number of successive frames, the input determination module may take steps to place the audio processing system 204 in the particular mode. For example, if the measured values of the IPD and ILD are within a predetermined threshold from the soft talking mode estimates for a successive number of frames, the input determination module may automatically place the audio processing system 204 into the soft talking mode. Alternatively, responsive to the measured ILD and IPD values being within the predetermined thresholds of the soft-talking estimates, the input determination module may set a state variable to a value corresponding to the soft talking mode. The state variable may be read by decision logic of a host application of the audio device 104 (e.g., stored in a system memory). The decision logic may be executable by the processor 202 of the audio device 104 to place the audio processing system 204 into a particular mode based at least in part on the reading of the state variable.

The mask generator module 312 receives models of the sub-band speech components s(k) and noise components n(k) as estimated by the noise suppression engine 310. The mask generator module 312 uses these calculations to generate a gain mask for the sub-band signals to provide to the modifier module 316. As will be described below, the mask generator module 312 generates a different gain mask for a given signal depending on the mode that the audio processing system 204 has been placed in by the user. For example, in soft-talking mode, the frequency-dependency of the gain mask generated by the mask generator module 312 differs significantly from that generated when the audio processing system 204 is in normal talking mode. The operation of the mask generator module 312 is described in more detail below with respect to FIG. 6.

The gate generator module 314 also receives models of the sub-band speech components s(k) and noise components n(k) as estimated by the noise suppression engine 310. In various embodiments, the gate generator module may also receive a long term running average of the noise component n(k) of the sub-band frame signals from the adaptive classifier of the noise suppression engine 310. In various embodiments, these inputs are used to generate a noise gate energy level. The gate generator module 314 may generate an attenuating multiplier to be applied to each of the noise-cancelled sub band signals c'(k) in a predetermined frequency range falling below the noise gate energy level. In some embodiments, the gate generator module 314 is only active when the audio processing system 204 has been placed in soft talking mode via an input from the user by the input device 208. As described below, the predetermined frequency range is specifically configured for a soft-talk use case. In other words, the attenuating multiplier is only applied to noise-cancelled sub-band signals c'(k) that are unimportant for speech intelligibility in the soft-talk use case. The attenuating multipliers generated by the gate generator module 314, as well as the multiplicative mask values generated by the mask generator module 312 are provided to the signal modifier which multiplies the gain masks to the noise-cancelled signal c'(k) generated by the noise subtraction engine 308 to produce a noise-cancelled-noise-suppressed signal c"(k). Operation of the gate generator module 314 will be described in greater detail below with respect to FIG. 6.

Frequency synthesis module 318 may convert the masked sub-band frame signals c"(k) from the cochlea domain back into the time domain. The conversion may include adding the masked sub-band frame signals c"(k) and phase shifted signals. Alternatively, the conversion may include multiplying the masked sub-band frame signals c"(k) with an inverse frequency of the cochlea channels. Once the conversion to the time domain is completed, the synthesized acoustic signal may be or be transmitted to an audio device (e.g., a phone) of an intended recipient.

In some embodiments, additional post-processing of the synthesized time domain acoustic signal may be performed. For example, comfort noise generated by a comfort noise generator may be added to the synthesized acoustic signal prior to providing the signal to the intended recipient. Comfort noise may be a uniform constant noise that is not usually discernible to a listener (e.g., pink noise). This comfort noise may be added to the synthesized acoustic signal to enforce a threshold of audibility and to mask low-level non-stationary output noise components. In some embodiments, the comfort noise level may be chosen to be just above a threshold of audibility and may be settable by a user. In some embodiments, the mask generator module 312 may have access to the level of comfort noise in order to generate gain masks that will suppress the noise to a level at or below the comfort noise.

Figure 4A:
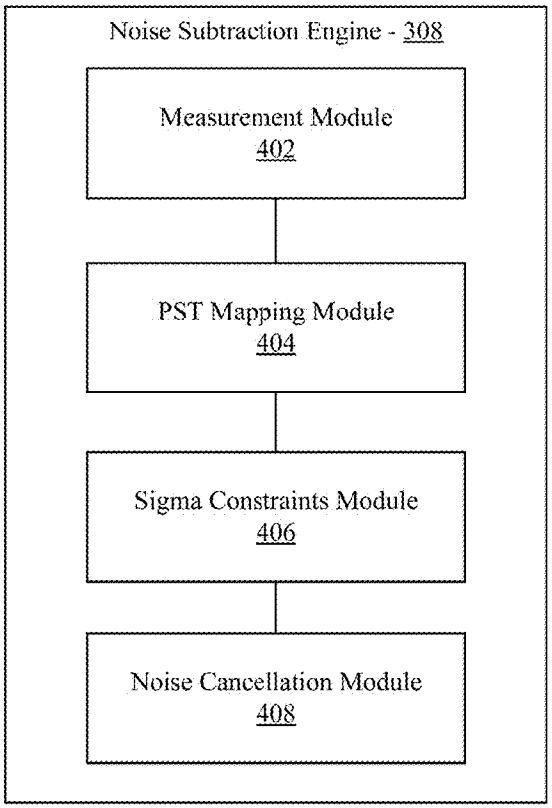
FIG. 4A comprises a block diagram of a noise subtraction engine of the audio processing system disclosed herein, according to an example embodiment.

FIG. 4A is a block diagram of the noise subtraction engine 308 of the audio processing system 204, according to an example embodiment. The noise subtraction engine 308 cancels out noise components in the primary sub-band frame signals c(k) to obtain noise-subtracted sub-band frame signals c'(k) by performing a multi-step adaptive cancellation process described below. As shown, the noise subtraction engine 308 includes a measurement module 402, a PST mapping module 404, a sigma constraints module 406, and a noise cancellation module 408.

The measurement module 402 is executable by the processor 202 to measure constants σ and ν that represent the interrelationship between the primary signal c(k) and secondary signal f(k). In the various embodiments disclosed herein, the constant σ may be dependent on where the audio device 104 is positioned relative to the speaker's mouth. The primary and secondary signals c(k) and f(k) are modeled as satisfying the relationship $$c(k)=s(k)+n(k), \text{ and}$$

$$f(k)=\sigma^*s(k)+\nu^*n(k)$$

where s(k) represents a speech component and n(k) represents a noise component, respectively. As such, the amplitude and phase of σ may represent an inter-microphone crosstalk between the speech component s(k) of the primary signal c(k) and the secondary signal f(k). Thus, if the coefficient σ is appropriately tuned to match the differences in the transfer functions of the primary microphone 106 and the secondary microphone 108 in the environment 100 for an audio signal emanating from the audio source, multiplying the primary signal c(k) by the coefficient σ and subtracting the result from the secondary signal f(k) results in a signal $$sd(k)=(\nu-\sigma)^*n(k)$$

with little to no speech component (herein referred to as the "speech devoid signal"). As such, the measurement module 402 is configured to measure various interrelationships between the primary signal c(k) and the secondary signal f(k) to measure the value of σ. In some embodiments, the value of σ is based on an inter-microphone energy level difference (ILD) and/or inter-microphone phase difference (IPD). In some embodiments, the measured value of σ may be related to a cross correlation between the primary signal c(k) and the secondary signal f(k). For example, the value of σ may be the cross correlation between the primary signal c(k) and the secondary signal f(k) divided by the autocorrelation of the primary signal c(k). In some embodiments, the measured value of σ is the first order least-squares predictor from one microphone to the other. As will be appreciated, the value of the measured σ coefficient may be complex having both an amplitude and a phase value.

In various embodiments, the noise cancellation module 408 does not actually apply the estimate of a as measured by the measurement module 402 to reach the speech devoid signal for a particular frame, but rather an adapted complex coefficient σ' that bears a relationship to the measured value σ. For a particular sub-band, the value that $\hat{\sigma}$ takes in a particular frame may bear a relationship to the value of $\hat{\sigma}$ in a previous frame:

$$\hat{\sigma}n(k)=\hat{\sigma}_{n-1}(k)+\mu^*\tau^*(\sigma_n(k)-\hat{\sigma}_{n-1}(k))$$

where μ is the step size, τ is a predetermined constant, $\hat{\sigma}_{n-1}(k)$ is the value of $\hat{\sigma}$ used in the previous frame, and $\sigma_n(k)$ is the value of σ as measured by the measurement module 402 for the current frame. In accordance with this relationship (herein referred to as "σ adaptation"), subject to the constraints disclosed herein, the value of $\hat{\sigma}$ recursively adapts towards observed values of a classified as speech at a rate proportional to the step size μ.

In various embodiments disclosed herein, σ adaptation does not occur in a particular frame unless various constraints are met. In other words, if the various constraints described below are not met, the value of $\hat{\sigma}'$ is maintained at what it was in the previous frame (i.e., $\hat{\sigma}_n(k)=\hat{\sigma}_{n-1}(k)$), which means that portions of the speech component of the signal s(k) will be cancelled out for that particular frame. As such, the constraints for a particular use case must be chosen carefully to avoid over-cancellation of the speech component.

In an example embodiment, two different types of constraints must be met in order for σ adaptation to occur in a particular frame: global constraints and local constraints. As referred to herein, the term "global constraints" refers to constraints applied to a σ as measured for a plurality of sub-bands or sub-bands in a particular frame. Examples of global constraints are discussed below with respect to the sigma constraints module 406. As referred to herein, the term "local constraints" refers to constraints applied to a particular value of σ as measured by the measurement module 402 for a particular frame for a particular sub-band. Local constraints may be used to define a classification boundary for determining if a signal energy level in a particular sub-band may be classified as either a speech component or a noise component. As described below, the values that local constraints take with respect to a particular sub-band is largely dependent on whether the audio processing system 204 is in a normal talking mode or a soft talking mode.

In accordance with the various embodiments disclosed herein, local constraints are also largely dependent on the level of position-suppression tradeoff ("PST") tolerated by the system. The level of PST tolerated by the system is largely dependent on the nature of the environment of the audio device 104. In this regard, the PST mapping module 404 is configured to determine the level of a PST parameter that is largely determinative of the level of PST that is to be tolerated at a particular sub-band in a particular frame. In the illustrative embodiments shown and described below, the value of the PST parameter may be inversely proportional to the stringency of the classification boundaries for deciding whether to adapt $\hat{\sigma}$. As such, the larger the level of the PST parameter, the more stringent the classification boundaries for σ as measured by the measurement module 402 are. The value of the PST parameter may be largely dependent on an estimated level signal to noise ratio ("SNR") in the primary signal c(k) as determined by the noise suppression engine 310 discussed above or by the measurement module 402. For more detail applicable to some embodiments, see U.S. Pat. No. 8,606,571, entitled "Spatial Selectivity Noise Reduction Tradeoff for Multi-Microphone Systems," which is incorporated by reference herein in its entirety.

The value that the PST parameter takes is determined via accessing a lookup table stored in the memory of the audio device 104. In various embodiments, the particular lookup table assessed by the PST mapping module 404 is dependent on the particular mode that the audio processing system 204 is currently operating in. For example, the memory of the audio device 104 may include two lookup tables. The first lookup table may have values of the PST parameter that have relatively high correlation with the estimated SNR and the second lookup table may have a relatively low correlation with the estimated SNR. In various example embodiments, the PST mapping module 404 accesses the first lookup table when the audio processing system 204 is in normal talking mode and accesses the second lookup table when the audio processing system 204 is in soft talking mode. As will be described below, in soft talking mode, it is presumed that the SNR will be low. Accordingly, the second lookup table de-emphasizes the estimated SNR. Further, it is also presumed that the user will maintain a relatively consistent position of the audio device 104 in soft talk mode. Given this assumption, and that a varies according the relative position of the audio device 104 to the user's mouth, the classification parameters are generally more stringent in the soft talk mode. Thus, the values of the PST parameter in the second lookup table will generally be higher than those in the first lookup table.

The sigma constraints module 406 is executable by the processor 202 to determine various local and global constraints used to determine whether σ adaptation will occur in a particular frame. With regard to the local constraints, the PST parameter measured by the PST mapping module 404 is used to compute the value of various configurable parameters Δϕ, $\delta_1$, and $\delta_2$ for a particular sub-band in a particular frame. In an example embodiment, the parameters Δϕ and $\delta_1$ are defined as follows:

$$\delta_1=\delta_{min}+x*(PST_{max}-PST_{meas})$$

$$\Delta\phi=\phi_{min}*2^{(PST_{max}-PST_{meas})*y}$$

where x and y are predetermined constants, $PST_{max}$ is the maximum value of PST allowed, and $\delta_{min}$ and $\Delta\phi_{min}$ represent the tightest spatial magnitude and phase constraints respectively at $PST_{max}$. In an example embodiment, the parameter $\delta_2$ bears a relationship to the factor $\delta_1$ that is dependent on the value of the PST parameter measured by the PST mapping module 404. As can be gathered from the above relationships, as the magnitude of $PST_{meas}$ returned by the PST mapping module 404 increases and approaches $PST_{max}$, the magnitude of the parameters Δϕ and $\delta_1$ respectively decrease. In other words, as the value of $PST_{meas}$ increases, the classification boundary for determining whether σ adaption will occur becomes more stringent. Thus, because the values of $PST_{meas}$ will be higher in the soft talking mode, the local constraints will be much more stringent in the soft talking mode. As will be described below, the parameters Δϕ, $\delta_1$, and $\delta_2$ define the so called "adaptation region" around a pre-calibrated reference value of σ. If the value of σ measured by the measurement module 402 fits within the adaptation region, σ adaptation may occur in a particular sub-band assuming the global constraints discussed below are met. Graphical depictions of the parameters Δϕ, $\delta_1$, and $\delta_2$ with respect to the normal talking and the soft talking modes are described below with respect to FIGS. 5A-5B.

It should be noted that, in some embodiments, the lookup tables used by the PST mapping module 404 may be similar to or the same irrespective of the current mode of the audio processing system 204. In such embodiments, at least one of the predetermined coefficients x, y, and $PST_{max}$ discussed above may take on a different value if the audio processing system 204 is placed in soft talking mode by the user. Generally speaking, however, the parameters Δϕ, $\delta_1$, and $\delta_2$ will still be smaller in the soft talking mode than they are in the normal talking mode.

With respect to global constraints, the sigma constraints module 406 is configured to tabulate a total number of sub-bands that meet the local constraints described above. In various example embodiments, a certain percentage of the total sub-bands in the primary signal c(k) must meet the respective local constraints in order for σ adaptation to occur in a particular frame. In an example embodiment, fifty percent of all sub-bands in the primary signal c(k) must meet the constraints discussed above in order for σ adaptation to occur. In various example embodiments, different global constraints may be set for various sub-band ranges. For example, a higher percentage (e.g., 60%) of sub bands in a certain frequency range (e.g., between 20 Hz and 20 kHz) may have to meet the local constraints discussed above in order for σ adaptation to occur. Other global constraints are envisioned. For example, one global restraint for σ adaption may be that the pitch salience of the primary signal c(k) is above a predetermined threshold (e.g., 0.7).

In various example embodiments, the global constraints used to determine if σ adaptation will occur vary depending on the mode that the audio processing system 204 is in. For example, in normal talking mode, global constraints may be assessed over a wide variety of sub-bands within the primary signal c(k). For example, in one embodiment, in normal talking mode, a fixed percentage of sub bands in the primary signal c(k) between 20 Hz and 20,000 Hz must meet the local restraints described above and the pitch salience across those sub-bands must meet a predetermined threshold. If, however, the audio processing system 204 is placed in the soft talking mode described herein, the range of sub-bands considered in deciding whether to adapt σ is narrower than when in the normal talking mode. In various example embodiments, frequency bands above a predetermined threshold are not considered in the global constraint determination in the soft talking mode. In one example embodiment, sub-bands above 4 kHz are not considered in determining if global constraints are met. Thus, only a certain percentage of sub-bands below 4 kHz must meet local constraints in order for σ adaption to occur. In another example embodiment, sub-bands above 2 kHz are not considered in determining if global constraints are met. In another example embodiment, sub bands above 1 kHz are not considered in determining if global constraints are met.

To summarize, the sigma constraints module 406 is configured to perform a multi-step process to determine whether σ adaptation is to occur in a particular sub-band in a particular frame. First, the sigma constraints module 406 determines the value of the local constraints for a particular sub-band based on the PST parameter generated by the PST mapping module 404. Then, the sigma constraint module determines if the local constraints are met in the sub-band by comparing the measured value of σ for that sub-band generated by the measurement module. This two-step process is repeated for all of the sub-bands in the primary signal c(k). After that, it is determined if various global constraints are met. For example, the sigma constraints module 406 may determine the percentage of sub-bands in various frequency ranges that meet the local constraints discussed above. In various example embodiments, if the global constraints are met, the sigma constraints module 406 performs σ adaptation for each sub-band meeting the local constraints.

The noise cancellation module 408 is executable by the processor 202 to perform a multi-step process to cancel out a noise component n(k) of the primary signal c(k) to produce a noise-cancelled signal c'(k). In this regard, the noise cancellation module 408 applies (i.e. multiples) the constant $\hat{\sigma}$, as adapted by the sigma constraints module 406, to the primary signal c(k) and subtracts the result from the secondary signal f(k) to produce a speech-devoid signal.

An adaptive coefficient α is then applied to the speech-devoid signal to produce an estimate of the noise component n(k) of the primary signal c(k). As discussed above, the speech-devoid signal is modeled as $(\nu-\sigma)*n(k)$, so the default value of the adaptive coefficient α is $(\nu-\sigma)^{-1}$. Like the constant σ discussed above, however, the constraint α is adaptively applied to the speech-devoid signal based on various characteristics of the primary signal c(k) and the secondary signal f(k). Also like the constant σ, adaptation of the constant α may be subject to various constraints. For more detail on possible example adaptations of α, see U.S. Pat. No. 8,204,253, entitled "Self-Calibration of Audio Device," and U.S. Pat. No. 8,949,120, entitled "Adaptive Noise Cancellation," which are both incorporated by reference herein in their entireties. After application of the constant α to the speech-devoid signal, the result is subtracted from the primary signal c(k) to produce a noise-cancelled signal c'(k).

Figure 4B:
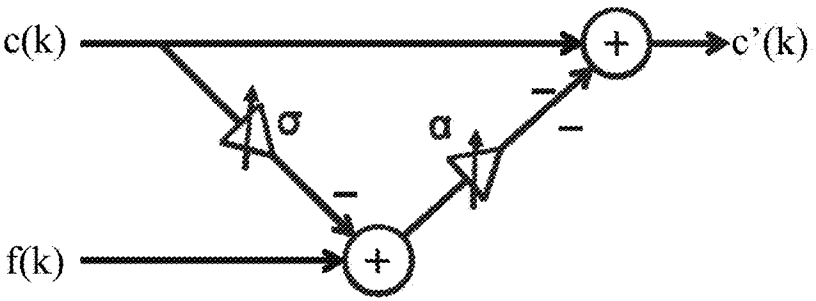
FIG. 4B comprises a schematic illustrating the operations of the noise subtraction engine illustrated in FIG. 4A, according to an example embodiment.

FIG. 4B is an exemplary schematic illustration of the operations of the noise cancellation module 408 in a particular frequency sub-band. As shown, the schematic includes a first branch and a second branch. In the first branch, the primary sub-band frame signals c(k) are multiplied by the adapted (subject to the local and global constraints disclosed herein) constant $\hat{\sigma}$. The product is then subtracted from the secondary sub-band frame signal f(k) to obtain a speech-devoid signal. In the second branch, the speech-devoid signal is multiplied by the constant α, and that product is subtracted from the primary signal c(k) to obtain the noise-cancelled signal c'(k).

It should be understood that, in various other embodiments, the noise cancellation module 408 may include additional branches. For example, in one embodiment, the audio device 104 includes an additional third microphone producing a tertiary audio signal t(k). In such arrangements, a secondary constant, $\sigma_2$, may also be applied to the primary signal c(k). The constant $\sigma_2$ may be determined in a similar manner to the constant $\hat{\sigma}$ discussed above and subject to similar constraints, except that the constant $\sigma_2$ is configured to track the interrelationship between the primary signal c(k) and the tertiary signal t(k) rather than the interrelationship between the primary signal c(k) and the secondary signal f(k). Once the constant $\sigma_2$ is applied, the result may be similarly subtracted from the tertiary signal t(k) to produce a second speech devoid signal. Another constant $\alpha_2$, similar to the constant $\alpha_1$ is then applied to the secondary speech devoid signal to product another noise-cancelled signal. A combination of the first noise-reference signal (e.g., produced by multiplying the constant σ to the first speech devoid signal sd(k)) and the second noise-reference signal may then be subtracted from the primary signal c(k) to produce an alternative noise-cancelled signal $c_2'(k)$.

Figure 5B:
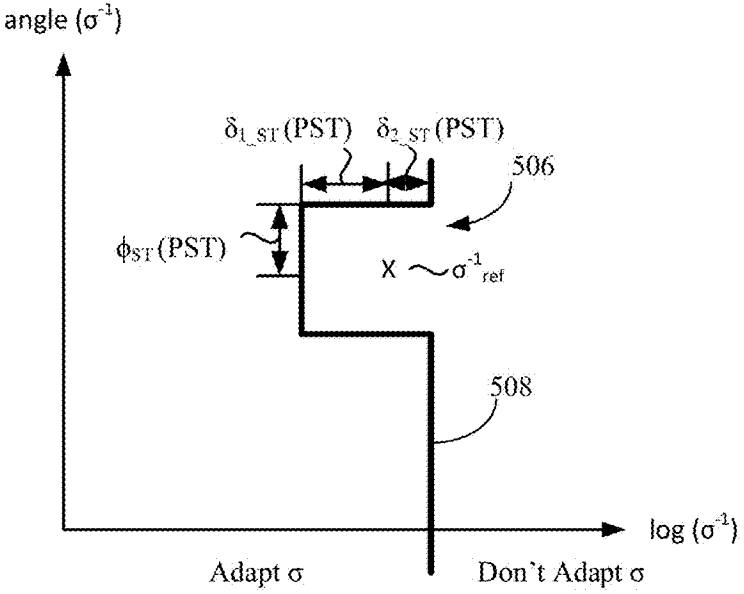
FIGS. 5A-5B comprise illustrative diagrams of spatial constraints used to adapt a noise cancellation constant, according to an example embodiment.
Figure 5A:
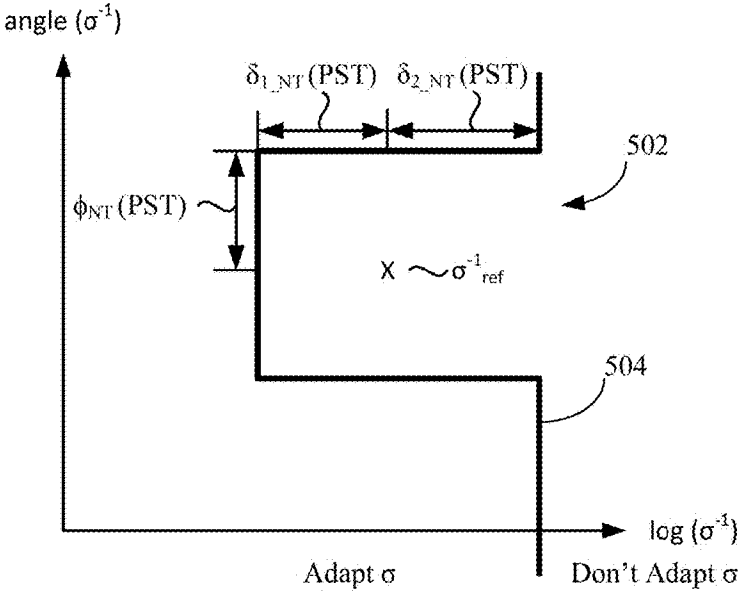

FIGS. 5A-5B illustrate example local constraints for a particular sub-band. In the example shown, FIG. 5A illustrates a set of local constraints for a sub-band when the audio processing system 204 is in a normal talking mode while FIG. 5B illustrates a set of local constraints for the same sub band when the audio processing system 204 is in the soft talking mode. The local constraints define a classification boundary that is determinative of whether σ adaptation takes place in a particular sub-band. The shape of the classification boundaries may be different than those illustrated in FIGS. 5A-5B. As shown, FIGS. 5A-5B are logarithmic plots of the inverse of the amplitude of σ as measured by the measurement module 402 against the phase of σ. The "x" marks the location of a reference value $\sigma^{-1}_{ref}$ that may be empirically determined through calibration. In the illustrated embodiment, the reference value $\sigma^{-1}_{ref}$ corresponds to the nominal usage position of the audio device 104.

The reference value $\sigma^{-1}_{ref}$ may be determined empirically through calibration using a head and torso simulator (HATS). A HATS system generally includes a mannequin with built-in ear and mouth simulators that provide a realistic reproduction of acoustic properties of an average adult human head and torso. The audio device 104 may be mounted on the mannequin, which may produce sounds that are received by the primary and secondary microphones 106 and 108 to produce signals that are used (e.g., by the measurement module 402) to measure the reference value $\sigma^{-1}_{ref}$ by any of the methods disclosed herein.

As shown, FIG. 5A shows the configurable parameters $\Delta\phi_{NT}$, $\delta_{1_NT}$, and $\alpha_{1_NT}$ for when the audio processing system 204 is in normal talking mode. As shown the parameters $\Delta\phi_{NT}$, $\delta_{1_NT}$, and $\delta_{1_NT}$ define an adaptation region 502 labelled "adapt σ" surrounding the reference value $\sigma^{-1}_{ref}$ in which σ adaptation takes place. In other words, when the audio processing system 204 is in a normal talking mode, the sigma constraints module 406 will only adapt the complex coefficient $\hat{\sigma}$ in a particular sub-band if the value σ as measured by the measurement module 402 satisfies the classification boundaries defined by the parameters $\Delta\phi_{NT}$, $\delta_{1_NT}$, and $\delta_{1_NT}$ (i.e., when the value of σ is to the right of the line 504). Otherwise, σ adaptation will not occur. In various example embodiments, the parameters $\Delta\phi_{NT}$, $\delta_{1_NT}$, and $\delta_{1_NT}$ are determined by the relationships discussed above with respect to the sigma constraints module 406.

Turning now to FIG. 5B, configurable parameters $\Delta\phi_{ST}$, $\delta_{1_ST}$, and $\delta_{1_ST}$ are shown for when the audio processing system 204 is in soft talking mode. Similar to FIG. 5A, the parameters $\Delta\phi_{ST}$, $\delta_{1_ST}$, and $\delta_{1_ST}$ define an adaptation region 506 to the right of line 508 labelled "adapt σ" surrounding the reference value $\sigma^{-1}_{ref}$ in which σ adaptation takes place. Comparison of the adaptation region 506 in FIG. 5A to the adaptation region 502 in FIG. 5B reveals that the classification boundary is much more stringent when the audio processing system 204 is in soft talking mode than when the audio processing system 204 is in normal talking mode. As such, in order for σ adaptation to take place in the soft talking mode, the values of σ returned by the measurement module 402 must maintain a close relationship to the reference value $\sigma^{-1}_{ref}$. Given that the value of σ returned by the measurement module 402 is largely dependent on the relative positioning of the audio device 104 in relation to the user's mouth, the noise cancellation process described herein is very sensitive to movements of the audio device 104 when the audio processing system 204 is in soft talking mode. However, assuming that the user maintains a relatively consistent positioning of the audio device 104 while the audio processing system 204 is in soft talking mode, this configuration enables for greater noise suppression robustness in the soft talk mode. In other words, any source of noise that is not emanating from the position of the user's mouth will be accurately classified as such and suppressed through the techniques described below. Specifically for when the user is speaking softly, when SNRs are low, this configuration enables for relatively large amounts of noise suppression (e.g., through the multiplicative mask generated by the mask generator module 312) and thus a more intelligible output signal.

Figure 6:
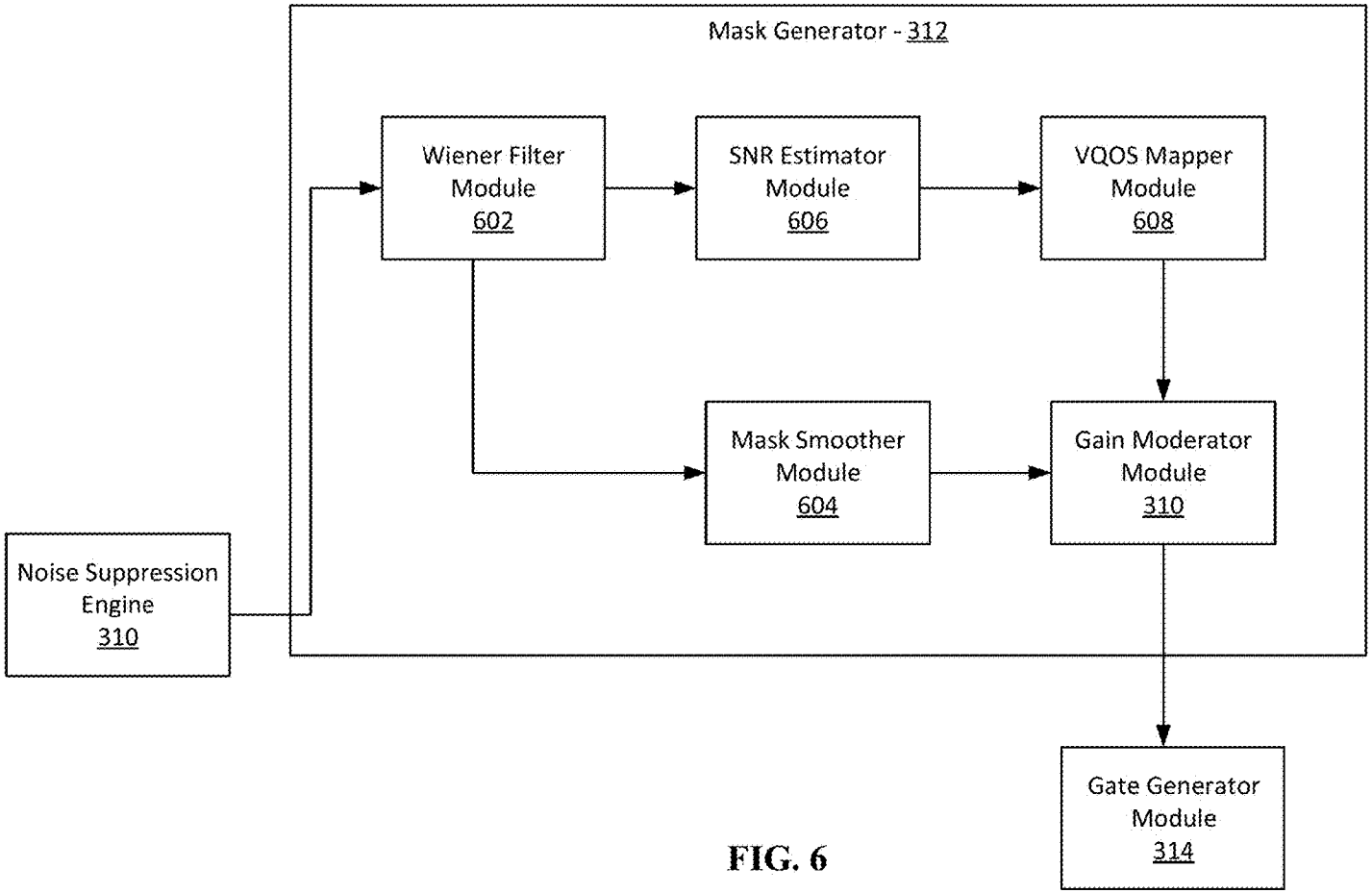
FIG. 6 comprises a block diagram of a mask generator module of the audio processing system disclosed herein, according to an example embodiment.

Referring now to FIG. 6, a block diagram of the mask generator module 312 is shown, according to an example embodiment. The mask generator module 312 may include a Wiener filter module 602, a mask smoother module 604, a SNR estimator module 606, a VQOS mapper module 608 and a gain moderator module 610. Mask generator module 312 may include more or fewer components than those illustrated in FIG. 6, and the functionality of modules may be combined or expanded into fewer or additional modules.

The Wiener filter module 602 receives the various outputs (e.g., power spectral densities of the speech and noise components of the primary signal c(k)) of the noise suppression engine 310 and calculates Wiener filter gain mask values $G_{wf}(t, \omega)$ for each sub-band of the primary acoustic signal c(k). The gain mask values may be based on the noise and speech short-term power spectral densities during time frame t and mathematically expressed as:

$$\frac{P_s(t, \omega)}{P_s(t, \omega) + P_n(t, \omega)}$$

where $P_s$ is the estimated power spectral density of speech in the sub-band signal ω of the primary signal c(k) and $P_n$ is the power spectral density of the noise in the sub-band signal ω of the primary acoustic signal as provided by the noise suppression engine 310. $P_s$ is to be computed mathematically as:

$$P_s(t,\omega)=\hat{P}_s(t-1,\omega)+\lambda_s*(P_y(t,\omega)-P_n(t,\omega)-\hat{P}_s(t-1,\omega))$$

$$\hat{P}_s(t,\omega)=P_y(t,\omega)*(G_{wf}(t,\omega))^2$$

where $\lambda_s$ is a constant (the so called "forgetting factor" of a $1^{st}$ order recursive IIR filter or leaky integrator), $P_y$ is the power spectral density of the noise-cancelled signal c'(k) output by the noise subtraction module.

According to the above relationships the Wiener filter gain mask values $G_{wf}(t, \omega)$ may introduce an undesirable level of distortion into the audio signal. This may particularly be a problem in situations where speech components s(k) of the primary signal c(k) are lower than the level of the noise components n(k). Thus, particularly in the soft-talk use case or cases where the SNR is low, the filter gain mask values $G_{wf}(t, \omega)$ produced by the relationships above may adversely affect the intelligibility of the primary audio signal c(k).

To limit the amount of speech distortion that occurs as a result of mask application, the Wiener gain values $G_{wf}(t, \omega)$ may be limited by a lower bound $G_{lb}(t, \omega)$. In various example embodiments the inverse of the value that $G_{lb}(t, \omega)$ takes represents the maximum suppression caused by application of the generated mask. The multiplicative mask values generated by the mask generator module 312 for a particular sub-band at a frequency ω and frame t can be mathematically expressed as the inverse of:

$$G_n(t,\omega)=\max(G_{wf}(t,\omega),G_{lb}(t,\omega))$$

where $G_n$ is the noise suppression mask, and $G_{lb}(t, \omega)$ may be a complex function of the instantaneous SNR in that sub-band signal, frequency, power, VQOS level. Given this, the SNR estimator 606 is executable by the processor 202 to receive the energy estimations of a the speech component s(k) and the noise component n(k) of the primary acoustic signal c(k) and estimates the instantaneous SNR for a particular sub-band in a particular frame. In various example embodiments, the instantaneous SNR may be the ratio of the long-term peak speech energy $\tilde{P}_s(t, \omega)$ to the instantaneous noise energy $\hat{P}_n(t, \omega)$. In various example embodiments, $\tilde{P}_s(t, \omega)$ may be calculated using a peak speech level tracker, as the average speech energy in the highest x dB of the speech signal's dynamic range. The speech level tracker may be reset upon a sudden drop in speech level. For example if the user switches the audio processing system 204 from soft talking mode to normal talking mode, the speech level tracker may be reset.

Using the instantaneous SNR estimate by the SNR estimator, the VQOS mapper generates a lower bound $G_{lb}(t, \omega))$ for the gain mask. In various embodiments, the lower bound $G_{lb}(t, \omega))$ can be mathematically expressed as:

$$G_{lb}(t,\omega)=f(VQOS,\omega,\mathrm{SNR})$$

where VQOS is a parameter that defines a maximum acceptable speech loss distortion resulting from application of the gain mask. In one example embodiment, VQOS is a discretized parameter taking one of a fixed number of values. Each value may define a level of speech distortion to be tolerated by the system. For example, in one embodiment, the VQOS parameter varies from 0 to 5, with a level of 0 indicating that little to no speech loss distortion is acceptable and 5 indicating that a large amount of speech loss distortion is acceptable. The value that the VQOS parameter takes may vary depending on the particular frequency sub-band and on particular properties of the primary acoustic signal.

In various example embodiments, once the VQOS parameter is obtained, the gain lower bound $G_{lb}(t, \omega)$ may be determined using a lookup table stored in the memory in the audio device 104. The lookup tables may be generated empirically. For example, various listeners may be presented with various signals having various levels of noise suppression and rate each signal from 0 to 5 on the level of distortion perceived. Other, more objective measures for estimating audio signal quality using computerized techniques, such as the inter-correlation between the masked-signal and the original primary signal c(k) are envisioned as well. In various example embodiments, the value that the VQOS parameter takes is proportional to the value that $G_{lb}(t, \omega)$ takes. As such, higher levels of the VQOS parameter (i.e., higher levels of allowable distortion) will generally lead to lower minimum bounds for noise suppression. In other words, the higher the level of the VQOS parameter, the more masking takes places.

In various example embodiments, the values of lower bound $G_{lb}(t, \omega)$, produced by the VQOS mapping module, is highly dependent on the current mode of the audio processing system 204. For example, different lookup tables may be used to determine the value of $G_{lb}(t, \omega)$ depending on whether the audio processing system 204 is in the normal talking mode or in the soft talking mode. For example, a first lower bound lookup table may be used in the normal talking mode to obtain a normal talking lower bound $G_{lb_NT}(t, \omega)$ and a second lower bound lookup table may be used in the soft talking mode to obtain a soft talking lower bound $G_{lb_ST}(t, \omega)$. Generally speaking, the second lower bound lookup table may contrast with the first lower bound lookup table in several respects. First, the values of $G_{lb_ST}(t, \omega)$ produced by the second lower bound lookup will have a different frequency dependency than values of $G_{lb_NT}(t, \omega)$ produced by the first lookup table. In one example embodiment, $G_{lb_NT}(t, \omega)$ has generally more continuous variations across frequencies than $G_{lb_ST}(t, \omega)$.

Generally, when users speak quietly, there is a downward frequency shift in important speech components s(k) of the primary acoustic signal c(k). As such, the portion of the speech component s(k) that is necessary for intelligibility is generally contained in lower frequency sub-bands than when the user talks normally. Also, the portion of the speech component that is less critical for intelligibility is contained in higher frequency sub-bands. Thus, in the soft talking mode, it is especially important to avoid speech distortion in lower frequency bands and less important to avoid distortion in higher frequency bands. Accordingly, the frequency-dependency of $G_{lb_ST}(t, \omega)$ in the soft-talking mode includes at least one discontinuity at a frequency threshold. For sub-bands below the frequency threshold, the value of $G_{lb_ST}(t, \omega)$ produced by the second lookup table will generally be lower than the values of $G_{lb_NT}(t, \omega)$ produced by the first lookup table. For sub-bands above the threshold, the values of $G_{lb_ST}(t, \omega)$ produced by the second lookup table will generally be above the values $G_{lb_NT}(t, \omega)$ by the first look up table. In the soft-talking mode, then, generally less masking will take place in lower frequency sub-bands while additional masking will take place in higher frequency sub-bands. Distortion of the most critical components of the speech signal s(k) for intelligibility is thus avoided, while noise is highly suppressed in frequency bands less important for intelligibility. It should be understood that more than one frequency threshold may be included in the second lookup table to apply varying levels of masking in different frequency ranges.

Another point of contrast between $G_{lb_ST}(t, \omega)$ and $G_{lb_NT}(t, \omega)$ may be that $G_{lb_ST}(t, \omega)$ is generally less dependent on the instantaneous SNR estimate generated by the SNR estimator module 606. As will be appreciated, when a user is speaking quietly, the SNR for the primary acoustic signal c(k) will generally be lower than when the user is talking normally. In normal talking mode, the value that $G_{lb_NT}(t, \omega)$ takes may be proportionally correlated to the instantaneous SNR of the primary signal c(k). In other words, the higher the SNR, the lower the value that $G_{lb_NT}(t, \omega)$ takes, resulting in more noise suppression by the generated mask. In the soft talking mode, however, the SNR will generally be lower across all frequency sub-bands. Accordingly, in various example embodiments, $G_{lb_ST}(t, \omega S$ less correlated with the instantaneous SNR than $G_{lb_NT}(t, \omega)$ is. This is especially the case in lower frequency sub-bands.

Another point of contrast between $G_{lb_ST}(t, \omega)$ and $G_{lb_NT}(t, \omega)$ may be that, in the soft talk mode, the value that the VQOS parameter takes at certain sub-bands may be lower than when the audio processing system 204 is in the normal talking mode. In one embodiment, in the second lookup table used to determine $G_{lb_ST}(t, \omega)$, the value of the VQOS parameter is systemically lower than what it is in the first lookup table used to determine $G_{lb_NT}(t, \omega)$. For example, in one embodiment, the VQOS parameter in normal talking mode may be set at a 1 across all frequency sub-bands, while the VQOS parameter in soft talking mode may be set at 0 across all frequency sub bands to produce a relatively lower level of distortion. In other embodiments, the variation in the VQOS parameter is dependent on the sub-band frequency. Turning back to the previous example, where the VQOS parameter in normal talking mode is set at 1 across all frequency sub-bands, in the soft talk mode, the VQOS parameter may be set at 0 below a first frequency threshold, 1 between the first frequency threshold and a second frequency threshold, and 2 above the second frequency threshold. Given that the value that $G_{lb}(t, \omega)$ takes is generally proportional to the value of the VQOS parameter, this results in a lower suppression below the first threshold, an intermediate level of suppression between the first and second thresholds, and a high level of suppression above the second threshold. This is consistent with the principles outlined above.

The gain moderator module 610 compares the value of $G_{lb}(t, \omega)$ for a particular frame to the value of $G_{wf}(t, \omega)$ to determine the mask multipliers to apply to the primary acoustic signal c(k) for a particular frame. In various example embodiments, the gain moderator module 610 takes whichever value is greater between $G_{wf}(t, \omega)$ and $G_{lb}(t, \omega)$ and inverts the greater value to determine the mask multiplier value for a particular sub-band in a particular frame.

It should be noted that, in various embodiments, the mask generator module 312 includes additional components. For example, in some embodiments, the minimum gain lower bound $G_{lb}(t, \omega)$ may not drop below a predetermined threshold (called the residual noise target level, or RNTL). Accordingly, the masking module may additionally include an RNTL estimator module configured to determine the RNTL for each sub-band in each frame. In some embodiments, the RNTL may be based on a second gain lower bound $G_{lb_2}(t, \omega)$ computed in a way similar to that discussed above, just using a different input signal. For example, a noise component of the primary acoustic signal c(k) may be reduced, additional SNR estimates made, and the value of $G_{lb_2}$ (t, ω) may be computed using the same lookup tables as discussed above to determine the RNTL. The mask generator module 312 may also include a mask smoothing module 604 that temporally smooths the Wiener Filter values as well as a voice activity detector (VAD) module. For a more detailed discussion of examples of a possible RNTL estimator module, mask smoothing module, and VAD module, see U.S. Pat. No. 9,143,857, entitled "Adaptively Reducing Noise While Limiting Speech Loss Distortion," the disclosure of which is incorporated herein by reference.

The mask multiplier values for a particular frame are then provided to the gate generator module 314 to determine a final set of multipliers to be applied to the noise-cancelled signal c'(k). In various example embodiments, in normal talking mode, the output from the mask generator module 312 are directly outputted to the signal modifier module 316 for application to the noise-cancelled signal c'(k) generated by the noise subtraction engine 308. In other words, in some embodiments, the gate generator module 314 is only applicable when the audio processing system 204 is in the soft talking mode.

The gate generator module 314 may perform a multi-step process to determine a noise gate to apply to the noise-cancelled signal c'(k). In various example embodiments, the gate generator module 314 receives the power spectral density estimates of the speech and noise components s(k) and n(k) of the primary acoustic signal c(k). The gate generator module 314 may track the average energy level of the noise component n at various frequency sub-bands over a predetermined period of time. The energy tracker may reset to a reference value if the energy level of the noise suddenly changes. Additionally, adjustments may be made for a particular energy level based on an estimate of the SNR of the primary acoustical signal.

Once the average noise energy level n is determined, the gating module may add a gating constant β to the determined average to determine a gating energy level. In some embodiments, the constant β is fixed (e.g., 3 dB). In other embodiments, the constant β varies depending on the circumstances. For example, in some embodiments the gating constant β is a fixed percentage (e.g., 10%) of the measured average noise energy level. Alternatively, the gating constant β may vary depending on the estimated SNR. For example, if the SNR is relatively high in a particular sub-band, the gating constant may be set at a lower value than if the SNR is lower.

Once the gating energy level $\bar{n}+\beta$ is determined, the mask multiplier values received from the mask generator module 312 are modified to incorporate a preconfigured noise gate. In various example embodiments, the preconfigured noise gate is configured to significantly attenuate signals within a certain frequency range falling below the gating energy level $\bar{n}+\beta$. Accordingly, the gate generator module 314 applies (e.g., multiplies) a multiplier reduction factor Ω to the mask multiplier values associated with sub band signals of the signal c'(k) having a total estimated signal energy falling below the gating energy level $\bar{n}+\beta$. Thus, low energy signals falling in the certain frequency range are heavily attenuated. In one example embodiment, the frequency range is 1.5 kHz to 20 kHz. In another example embodiment, the frequency range is from 2 kHz to 6 kHz. In another example embodiment, the frequency range is from 2.5 kHz to 3.7 kHz.

Figure 7:
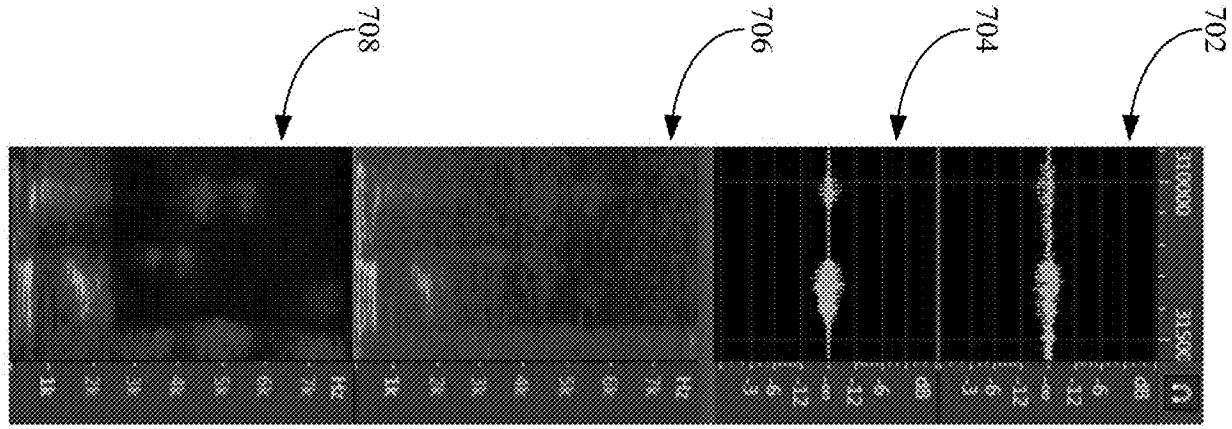
FIG. 7 comprises a plot of an output signal processed by the audio processing system disclosed herein, according to an example embodiment.

Turning now to FIG. 7, comparison signal outputs are shown. FIG. 7 shows a comparison of the results of applying the soft talking mode filters (e.g., the mask generated by the mask generating module and the gate generated by the gate generating module) disclosed herein. FIG. 7 includes a first time domain signal 702 and a second time domain signal 704. The first time domain signal 702 is amplified, but unprocessed by the methods disclosed herein. The second time domain signal 704 contrasts with the first time domain signal 702 due to processing by the various filters disclosed herein. As can be seen, the signal 704 includes better defined boundaries separating speech from noise components than the signal 702, resulting in a clearer, more intelligible output.

FIG. 7 also includes an unprocessed frequency domain signal 706 and a processed frequency signal 708. As can be seen by comparing the unprocessed signal 706 to the processed signal 708, the mask generated by mask generator module 312 heavily suppresses signals in upper frequency domains (above about 2.5 kHz). Additionally, the noise gate generated by the gate generator module 314 applies an even heavier suppression within a predetermined frequency range (as shown, the range is between 2.5 kHz and 3.7 kHz). This significant reduction of certain higher frequency produces well-classified time domain output signal 704 discussed above. As such, the systems and methods disclosed herein are a significant improvement over conventional amplification techniques for a soft talking use case.

Figure 8:
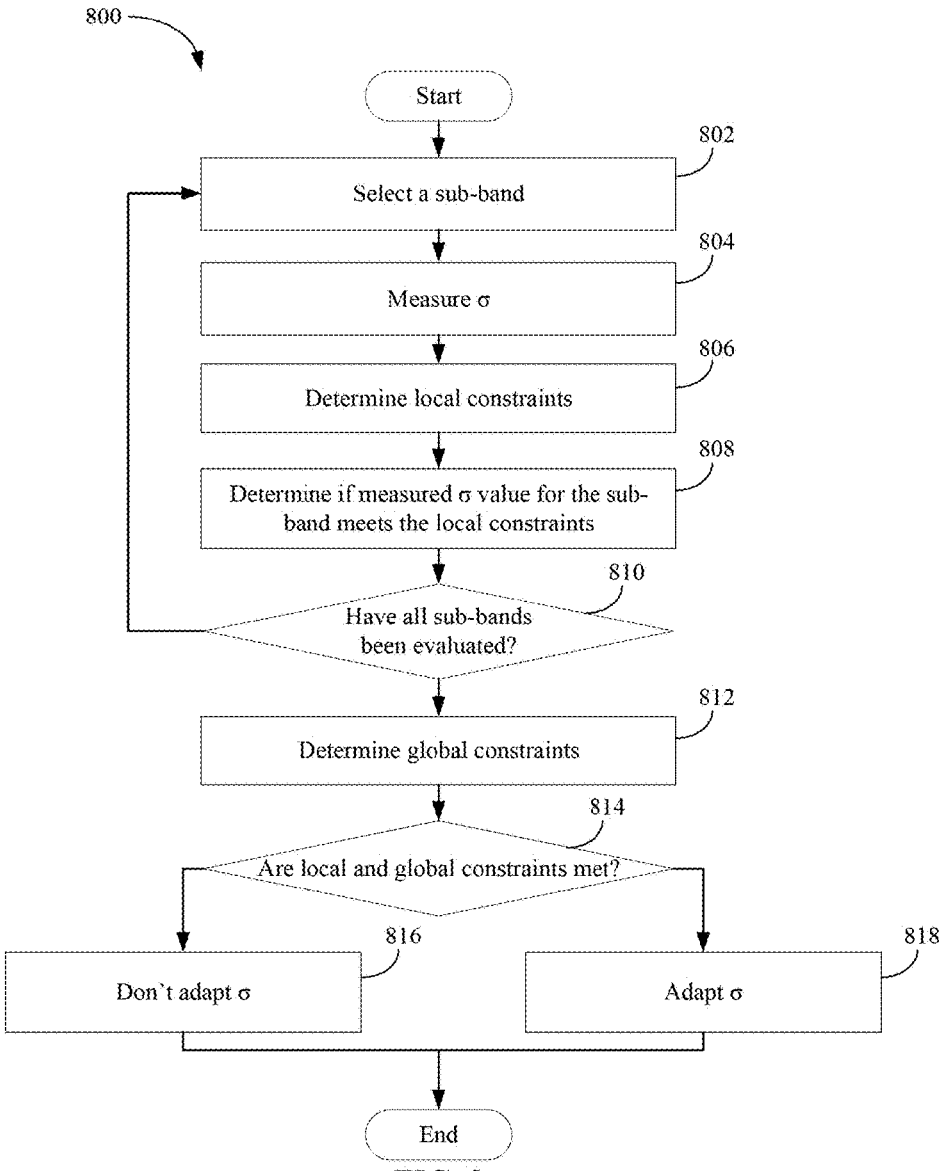
FIG. 8 comprises a flow chart of a method of adapting a noise cancellation constant, according to an example embodiment.

Referring now to FIG. 8, a flow chart of a method 800 for adapting a noise cancellation coefficient is shown, according to an example embodiment. In some embodiments, the method 800 is initially performed after audio signals are received by the audio device 104 and is then continuously performed by the noise subtraction engine 308 for each time frame of the received audio signals. For example, the primary and secondary microphones 106 and 108 may receive the audio signals and the frequency analysis module 302 may perform a frequency analysis on the audio signals. The resulting frequency-analyzed signals are then forwarded to the noise subtraction engine 308 to initiate the method 800.

A sub-band is selected at 802. In various embodiments, the method 800 involves performing an analysis of all the sub-bands of the received acoustic signals. Accordingly, in one embodiment, the noise subtraction engine 308 initially selects the lowest frequency sub-band of the received acoustic signals and repeats steps 802-808 for the next lowest sub-band until all sub-bands are assessed.

After a sub-band is selected, σ is measured for that particular sub-band by the measurement module 402 at step 804. As discussed above, in situations, the value of σ may include an ILD value and an IPD value between the primary signal and the secondary signal. In other situations the measured value of σ is a cross correlation between the primary signal c(k) and the secondary signal f(k) divided by the autocorrelation of the primary signal c(k). In some situations the measured value of σ is the first order least-squares predictor from one microphone to the other. In some embodiments, the method through which σ is measured is based on the mode that the audio processing system 204 is currently operating in. For example, in normal talking mode, the measurement module 402 may measure σ by determining an ILD/IPD value while, in the soft talking mode, the measurement module 402 may measure σ using an inter-correlation approach. In exemplary embodiments, the observed σ coefficient value will be a complex value having a magnitude and a phase.

Upon measurement of σ, local constraints are determined at step 806. In various example embodiments, the measured value of σ for a particular frame must meet the determined local constraints in order for the coefficient $\hat{\sigma}$ to be adapted from the previous frame. Accordingly, the PST mapping module 404 uses an estimate of the SNR in the primary audio signal c(k), for example, to determine a value for a PST parameter by accessing a lookup table. The PST parameter is then used to compute the parameters $\Delta\phi$, $\delta_1$, and $\delta_2$ defining the classification parameters for the selected sub-band. As discussed above, the value that the parameters $\Delta\phi$, $\delta_1$, and $\delta_2$ take is largely dependent on the mode that the audio processing system 204 is operating in. For example, if the audio processing system 204 is in normal talking mode, the PST mapping module 404 may access a first lookup table to determine values $\Delta\phi_{NT}$, $\delta_{1_NT}$, and $\delta_{2_NT}$ while, in soft talking mode, the PST mapping module 404 may access a second lookup table to determine values $\Delta\phi_{ST}$, $\delta_{1_ST}$, and $\delta_{2_ST}$. Generally speaking, the values of $\Delta\phi_{NT}$, $\delta_{1_NT}$, and $\delta_{2_NT}$ will be larger and more correlated to the SNR estimate than the values of $\Delta\phi_{ST}$, $\delta_{1_ST}$, and $\delta_{2_ST}$. Thus, the local constraints are less stringent in the normal talking mode than they are in the soft talking mode.

Upon determination of the local constraints, the measured $\sigma$ value is assessed to determine if the local constraints are met at 808. For example, the sigma constraint module may compare the magnitude and phase of the measured $\sigma$ value to those of a corresponding reference value $\sigma^{-1}_{ref}$. In various example embodiments, the parameters $\delta_1$ and $\delta_2$ may define a distance that the magnitude of the measured value of $\sigma$ may be above or below the magnitude of the reference value $\sigma^{-1}_{ref}$. Accordingly, the magnitude of the measured $\sigma$ value is compared with the magnitude of the reference value $\sigma^{-1}_{ref}$ to determine if the measured $\sigma$ value is within the range defined by $\delta_1$ and $\delta_2$. Additionally, the parameter $\Delta\phi$ defines a distance that the phase of the measured value of $\sigma$ may be from the phase of the reference value $\sigma^{-1}_{ref}$. Accordingly, the phase of the measured $\sigma$ value is compared to the phase of $\sigma^{-1}_{ref}$ to determine if the range established by $\Delta\phi$ is satisfied.

It is determined if all of the sub-bands of the received acoustic signals have been evaluated at step 810. If not, the noise subtraction engine 308 reverts back to step 802 to select another sub-band and repeats the steps 804-808 for that sub-band. After the process 802-808 is repeated for all sub-bands in the received acoustic signals, global restraints are determined at step 812. As discussed above, in various embodiments, in order for $\sigma$ adaptation to occur, various restraints across multiple sub-bands must be met. For example, one global constraint may be that the pitch salience of the primary acoustic signal c(k) is above a predetermined threshold. Another global constraint may be that no echo is detected in either the primary acoustic signal c(k) or the secondary acoustic signal f(k).

In some embodiments, some global constraints may involve a fixed percentage of sub-bands meeting the local constraints discussed above. For example, in one embodiment, 50% of all sub-bands must meet the local constraints discussed above in order for any $\sigma$ adaption to occur. Another global restraint may involve a higher percentage (60%) of sub-bands in a lower frequency range (e.g., 20 Hz to 1 kHz) meet the global restraints discussed above. In various example embodiments, the sub-bands considered in terms of global constraints varies depending on the current mode of the audio processing system 204. For example, in some embodiments, in normal talking mode all sub-bands of the received acoustic signals are considered for determining if the global restraints are met. In the soft talking mode, however, only a subset of frequency bands are considered. In one example, only sub-bands having a frequency below 4 kHz are considered in the soft talking mode. In another example, only sub-bands having a frequency below 2 kHz are considered in the soft talking mode. In another example, only sub-bands having a frequency below 1 kHz are considered in the soft talking mode.

It is determined if the global constraints are met at step 814. For example, the pitch salience of the primary acoustic signal may be compared with a predetermined threshold. Estimated noise energies may be compared with another threshold. The percentage of sub-bands in various frequency ranges meeting the local constraints discussed above are compared with various percentage thresholds. If these thresholds are satisfied, the global restraints are met.

If the global restraints are not met, $\sigma$ is not adapted at step 816. In other words the value of the coefficient $\hat{\sigma}$ that is applied to the primary acoustic signal by the noise cancellation module 408 will be the same as the coefficient $\hat{\sigma}$ was in the previous frame for all sub-bands. If, however, the global restraints are met, $\sigma$ adaptation takes place in all sub bands that were determined to meet the local restraints during various iterations of the step 808. The value of the coefficient $\hat{\sigma}$ for those sub-bands will be updated thus:

$$\hat{\sigma}_n(k)=\hat{\sigma}_{n-1}(k)+\mu*\tau*(\sigma_n(k)-\hat{\sigma}_{n-1}(k))$$

where $\mu$ is the step size, $\tau$ is a predetermined constant, $\hat{\sigma}_{n-1}(k)$ is the value of $\hat{\sigma}$ used in the previous frame, and $\sigma_n(k)$ is the value of $\sigma$ as measured by the measurement module 402 for the current frame.

Figure 9:
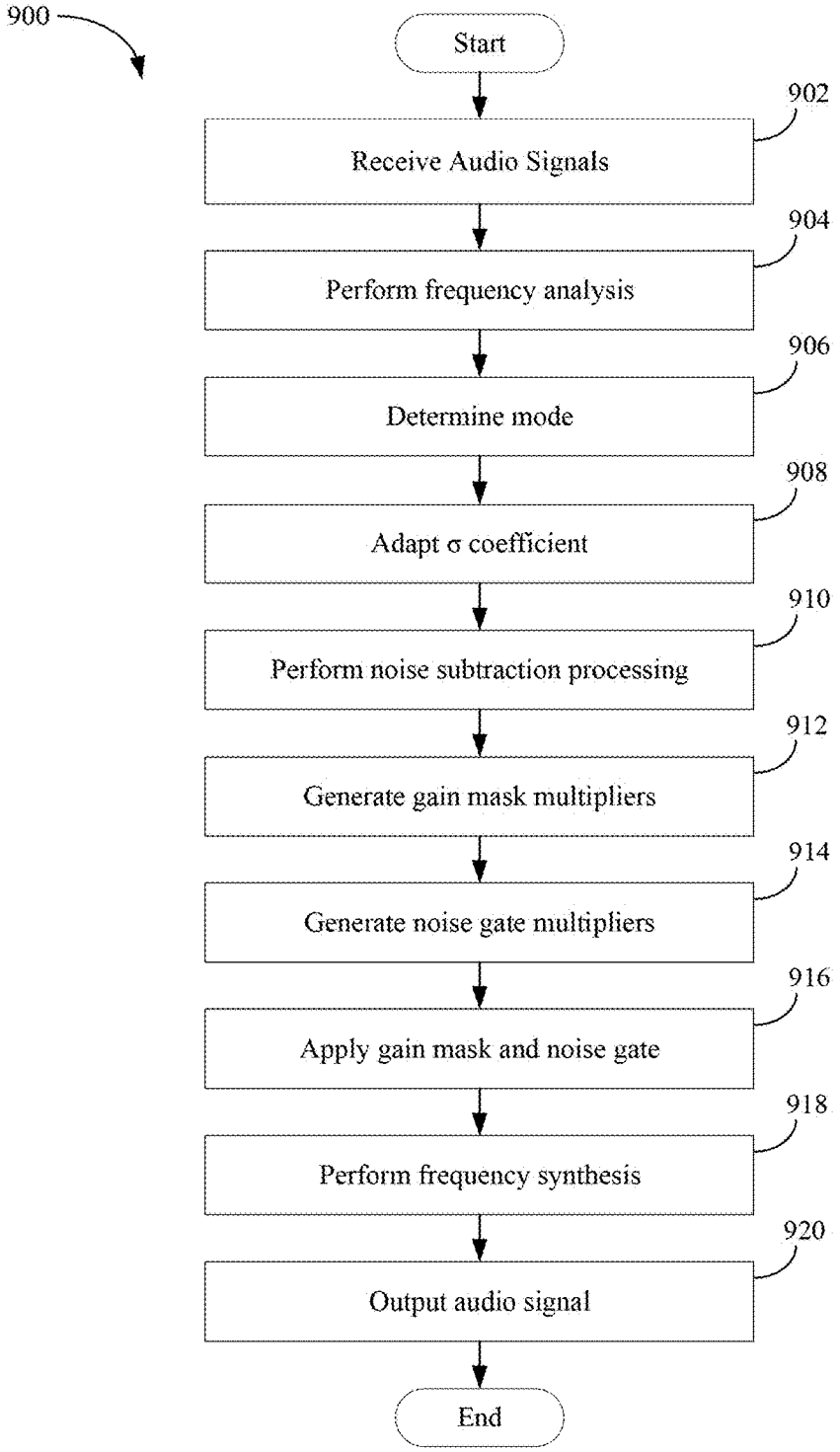
FIG. 9 comprises a flow chart of a method of processing an audio signal, according to an example embodiment.

Referring now to FIG. 9, a flow chart of a method 900 for suppressing noise in an audio device 104 is shown, according to an example embodiment. Audio signals are received by the audio device 104 in step 902. In exemplary embodiments, a plurality of microphones (e.g., primary and secondary microphones 106 and 108) receive the audio signals (i.e., acoustic signals). The plurality of microphones may comprise a close microphone array or a spread microphone array.

Frequency analysis on the primary and secondary acoustic signals may be performed at step 904. In one embodiment, the frequency analysis module 302 utilizes a filter bank to determine frequency sub-bands for the primary and secondary acoustic signals.

The mode of the audio processing system 204 is determined at step 906. In various example embodiments a user may put the audio processing system 204 into various modes by providing an input to the audio device 104 via the input device 208. For example, as the user is talking into the audio device 104, a host application being executed by the processor 202 of the audio device 104 may present the user (e.g., via a display on the audio device 104) with a graphic configured to receive an input from the user to place the audio processing system 204 in soft-talking mode. As such, the audio processing system 204 may operate in normal talking mode as a default. The audio processing system 204 may enter soft talking mode for a predetermined period of time after receiving such an input. Alternatively or additionally, the audio processing system 204 may enter soft talking mode when an input is received from the user and stay in soft talking mode until the signal energy detected by the primary microphone and/or secondary microphone drops below a predetermined threshold (e.g., the user stops speaking). Alternatively, the audio processing system 204 may stay in soft talking mode until noise energy estimates rise above a predetermined threshold. Alternatively, the audio processing system 204 may stay in soft talking mode until a percentage of sub-bands meeting the local constraints discussed above in relation to FIG. 8 drops below a predetermined threshold for a successive number of frames. In some embodiments, the mode of the audio processing system 204 is determined based on an input received from an input determination module as discussed above. For example, the noise determination module may compare various cues measured by the noise suppression engine 310, discussed above with various reference values associated with the soft talking mode and, if the measured cues are within a predetermined threshold of the reference values for a successive number of frames, the input determination module may provide an input to the audio processing system 204.

The σ coefficient is adapted at step 908. In various example embodiments, the noise subtraction engine 308 performs the method 800 discussed above in relation to FIG. 8. After the σ coefficient is adapted, noise subtraction processing is performed at step 910. More details of possible noise subtraction processing for use in embodiments are described in U.S. Pat. No. 9,185,487, entitled "System and Method for Providing Noise Suppression Utilizing Null Processing Noise Subtraction," which is incorporated by reference herein.

Gain mask multipliers are generated at step 912. In various example embodiments, the mask generator module 312 generates Wiener filter gain levels $G_{wf}(t, \omega)$, calculates gain lower bounds $G_{lb}(t, \omega)$), and chooses a mask multiplier that is the higher of the two. As discussed above, the value of the gain lower bounds $G_{lb}(t, \omega)$) generated by the mask generator module 312 will vary depending on the mode that the audio processor 202 is in as determined at step 906. Accordingly, in some embodiments, the mask generator module 312 uses different VQOS lookup tables depending on whether the audio processing system 204 is in soft talking mode or in normal talking mode. Generally speaking, in the soft talking mode, the gain lower bounds $G_{lb}$ (t, ω)) are configured such that masking is more aggressive (i.e., the lower bound is lower to generate more noise suppression) in higher frequency sub-bands than in the normal talking mode and less aggressive (i.e. the lower bound is higher to generate less noise suppression) in the lower frequency sub-bands.

Noise gate multipliers are generated at step 914. In various example embodiments, the audio processing system 204 may skip the step 914 when the audio processing system 204 is in normal talking mode. In other words, if the audio processing system 204 is determined to be in normal talking mode at step 906, step 914 may be skipped. As discussed above, to generate noise gate multipliers, the gate generator module 314 first determines an average noise energy level $\bar{n}$ for a particular sub-band or across various sub-bands within a pre-specified frequency range. Next, a gating constant β is added to the average noise energy level $\bar{n}$ to compute a gating energy level $\bar{n}+_R$. Next, if the total energy of the noise-cancelled signal c'(k) in a particular sub-band within a predetermined frequency range is below the gating energy level, an attenuating multiplier Ω is generated for that particular sub-band to provide additional suppression of that sub-band. In some embodiments, the multiplier Ω is a constant applied to all sub-band signals in the predetermined frequency range. In an example, the predetermined frequency range is from 2.5 kHz to 3.7 kHz.

The noise gate and mask multipliers are applied at step 916. In one embodiment, the gain mask may be applied by the signal modifier module 316 on a per sub-band signal basis. In some embodiments, the gain mask and noise gate may be applied to the noise subtracted signal c'(k) outputted by the noise subtraction engine 308 in the signal modifier module 316. The sub-band signals may then be synthesized at the frequency synthesis module 318 at step 918 to generate the output. In one embodiment, the sub-band signals may be converted back to the time domain from the frequency domain. Once converted, the audio signal may be output to the user at step 920. The output may be via a speaker, earpiece, or other similar devices.

Preferred embodiments of this invention are described herein It should be understood that the illustrated embodiments are exemplary only, and should not be taken as limiting the scope of the invention.

What is claimed is:

1. A method for reducing noise within an acoustic signal comprising:

receiving at least a primary acoustic signal from a primary microphone and a secondary acoustic signal from a different, secondary microphone, wherein the primary acoustic signal includes a speech component emanating from a user and a noise component;

separating, by a processor, the primary microphone acoustic signal and the secondary acoustic signal into a plurality of sub-band signals to create a plurality of primary sub-bands and a plurality of secondary sub-bands;

measuring, by the processor, a first value of a first coefficient for a first sub-band based on the primary sub-bands and the secondary sub-bands;

performing, by the processor, a cancellation of the noise component based on the measured first value of the first coefficient to produce a set of noise-cancelled primary sub-bands;

generating, by the processor, a set of multiplicative gain mask values to be applied to the noise-cancelled primary sub-bands, the multiplicative gain mask values having a frequency dependency that is based at least in part on a pre-indicated approximate sound pressure level of the speech component, wherein the multiplicative gain mask values have a first frequency dependency when the pre-indicated approximate sound pressure level of the speech component is at a first level, and a different second frequency dependency when the pre-indicated approximate sound pressure level of the speech component is at a different second level; and applying, by the processor, the multiplicative gain mask values to the noise-cancelled primary sub-bands.

2. The method of claim 1, further comprising:

determining, by the processor, an estimated energy level of the noise component;

generating, by the processor, a set of multiplicative noise gate values to be applied to a subset of the primary sub-bands falling below an energy threshold that is at least the estimated energy level of the noise component; and applying, by the processor, the multiplicative noise gate values to the subset of noise-cancelled primary sub-bands.

3. The method of claim 2, wherein the subset of primary sub-bands is a set of sub-bands in a first predetermined frequency range.

4. The method of claim 3, wherein the first predetermined frequency range is between 2 kHz and 4 kHz.

5. The method of claim 4, wherein the first predetermined frequency range is between 2.5 kHz and 3.7 kHz.

6. The method of claim 1, further comprising receiving, by an input device, a user input, wherein the pre-indicated approximate sound pressure level of the speech component is based at least in part on the received input.

7. The method of claim 1, wherein the pre-indicated approximate sound pressure level is either at the first level or at the second level, wherein the first level corresponds to a situation where the speech component is at a sound pressure level of average conversational speech, the sound pressure level of average conversational speech being approximately 60 dB, wherein the second level corresponds to a situation where the speech component is at a sound pressure level of lower than that of average conversational speech.

8. The method of claim 7, further comprising, determining whether the first measured value of the first coefficient meets a first threshold, wherein the value of the first threshold is dependent on whether the pre-indicated approximate sound pressure level is at the first level or the second level.

9. The method of claim 8, wherein the threshold is smaller when the pre-indicated approximate sound pressure level is at the second level.

10. The method of claim 8, further comprising:

measuring, by the processor, a plurality of additional values of the first coefficient for a plurality of additional sub-bands based on the primary sub-bands and the secondary sub-bands;

determining, by the processor, whether each of the plurality of additional values of the first coefficient meet a plurality of additional thresholds, wherein each of the plurality of additional values of the first coefficient has an associated threshold;

determining by the processor, a percentage of the plurality of additional values of the first coefficient that meet their associated threshold; and adapting the value of a second threshold for the first sub-band if both the first measured value meets the first threshold and if the percentage meets a predetermined percentage threshold.

11. The method of claim 10, further comprising wherein the plurality of additional sub-bands are within a second predetermined frequency range, wherein the second predetermined frequency range is dependent on whether the pre-indicated approximate sound pressure level is at the first level or the second level.

12. A system for suppressing noise, comprising:

a microphone array including a primary microphone and a secondary microphone, wherein the microphone array is configured to receive at least a primary acoustic signal from the primary microphone and a secondary acoustic signal from the secondary microphone, wherein the primary acoustic signal includes a speech component emanating from a user and a noise component;

a frequency module configured to separate the primary microphone acoustic signal and the secondary acoustic signal into a plurality of sub-band signals to create a plurality of primary sub-bands and a plurality of secondary sub-bands;

a noise subtraction engine configured to measure a first value of a first coefficient for a first sub-band based on the primary sub-bands and the secondary sub-bands; and perform a cancellation of the noise component based on the measured first value of the first coefficient to produce a set of noise-cancelled primary sub-bands;

a mask generator module configured to generate a set of multiplicative gain mask values to be applied to the noise-cancelled primary sub-bands, the multiplicative gain mask values having a frequency dependency that is based at least in part on a pre-indicated approximate sound pressure level of the speech component, wherein the multiplicative gain mask values have a first frequency dependency when the pre-indicated approximate sound pressure level of the speech component is at a first level, and a different second frequency dependency when the pre-indicated approximate sound pressure level of the speech component is at a different second level; and signal modifier module configured to apply the multiplicative gain mask values to the noise-cancelled primary sub-bands.

13. The system of claim 12, further comprising:

a gate generator module configured to:

determine an estimated energy level of the noise component; and generate a set of multiplicative noise gate values to be applied to a subset of the primary sub-bands falling below an energy threshold that is at least as high as the estimated energy level, wherein the signal modifier is further configured to apply the multiplicative noise gate values to the subset of noise-cancelled primary sub-bands.

14. The system of claim 13, wherein the subset of primary sub-bands is a set of sub-bands in a first predetermined frequency range.

15. The system of claim 14, wherein the first predetermined frequency range is between 2.5 kHz and 3.7 kHz.

16. The system of claim 12, further comprising an input device configured to receive a user input, wherein the pre-indicated approximate sound pressure level of the speech component is based at least in part on the received input, wherein the pre-indicated approximate sound pressure level is either at the first level or at the second level, wherein the first level corresponds to a situation where the speech component is at a sound pressure level of average conversational speech, wherein the second level corresponds to a situation where the speech component is at a sound pressure level of lower than that of average conversational speech, wherein the sound pressure level of average conversational speech is approximately 60 dB.

17. The system of claim 16, wherein the noise subtraction engine is further configured to determine whether the first measured value of the first coefficient meets a first threshold, wherein the value of the first threshold is dependent on whether the pre-indicated approximate sound pressure level is at the first level or the second level.

18. The system of claim 17, wherein the threshold is smaller when the pre-indicated approximate sound pressure level is at the second level.

19. The system of claim 17, wherein the noise subtraction engine is further structured to:

measure a plurality of additional values of the first coefficient for a plurality of additional sub-bands based on the primary sub-bands and the secondary sub-bands;

determine whether each of the plurality of additional values of the first coefficient meet a plurality of additional thresholds, wherein each of the plurality of additional values of the first coefficient has an associated threshold;

determine a percentage of the plurality of additional values of the first coefficient that meet their associated threshold; and adapt the value of a second threshold for the first sub-band if both the first measured value meets the first threshold and if the percentage meets a predetermined percentage threshold.

20. The system of claim 19, wherein the plurality of additional sub-bands are within a second predetermined frequency range, wherein the second predetermined frequency range is dependent on whether the pre-indicated approximate sound pressure level is at the first level or the second level.

* * * * *